US005987859A

United States Patent [19]

Dreger

[11] Patent Number: 5,987,859

[45] Date of Patent: Nov. 23, 1999

[54] PRODUCT ORIENTATION FOR ELONGATED PRODUCTS

[75] Inventor: Douglas D. Dreger, Kiel, Wis.

[73] Assignee: Hayssen, Inc., Duncan, S.C.

[21] Appl. No.: 09/122,510

[22] Filed: Jul. 24, 1998

[51] Int. Cl.[6] ..... B65B 35/30

[52] U.S. Cl. ..... 53/544; 53/54; 53/525

[58] Field of Search ..... 53/54, 437, 446, 53/494, 525, 544

[56] References Cited

U.S. PATENT DOCUMENTS

| | | | |
|---|---|---|---|
| 3,842,569 | 10/1974 | McClelland et al. | 53/525 X |
| 3,990,209 | 11/1976 | Eisenberg | 53/525 X |
| 3,994,321 | 11/1976 | Eisenberg | 53/534 X |
| 4,019,547 | 4/1977 | Ross | 53/525 X |
| 4,054,015 | 10/1977 | Rowell | 53/544 X |
| 4,265,072 | 5/1981 | Egli | 53/544 X |
| 4,514,959 | 5/1985 | Shroyer | 53/525 X |
| 4,519,179 | 5/1985 | Meier | 53/525 X |
| 4,586,313 | 5/1986 | Maglecic | 53/451 X |
| 4,607,478 | 8/1986 | Maglecic | 53/544 X |
| 4,629,017 | 12/1986 | Shroyer | 53/77 X |
| 4,843,795 | 7/1989 | Shroyer | 53/525 X |
| 4,955,178 | 9/1990 | Shroyer | 53/544 X |
| 4,965,984 | 10/1990 | Farnsworth et al. | 53/544 X |
| 5,001,889 | 3/1991 | Mueller | 53/525 X |
| 5,473,866 | 12/1995 | Maglecic et al. | 53/544 X |

*Primary Examiner*—Daniel B. Moon
*Attorney, Agent, or Firm*—Lee, Mann, Smith, McWilliams, Sweeney & Ohlson

[57] ABSTRACT

An orientation device for vertically orienting products in a vertical form, fill and seal machine. It includes a product receipt station for receiving a plurality of unoriented products and a product discharge station for discharging a plurality of oriented products. The products are indexed in discrete groups from the product receipt station to the product discharge station, during which the products of each group are oriented with their longitudinal axes being essentially vertical.

20 Claims, 6 Drawing Sheets

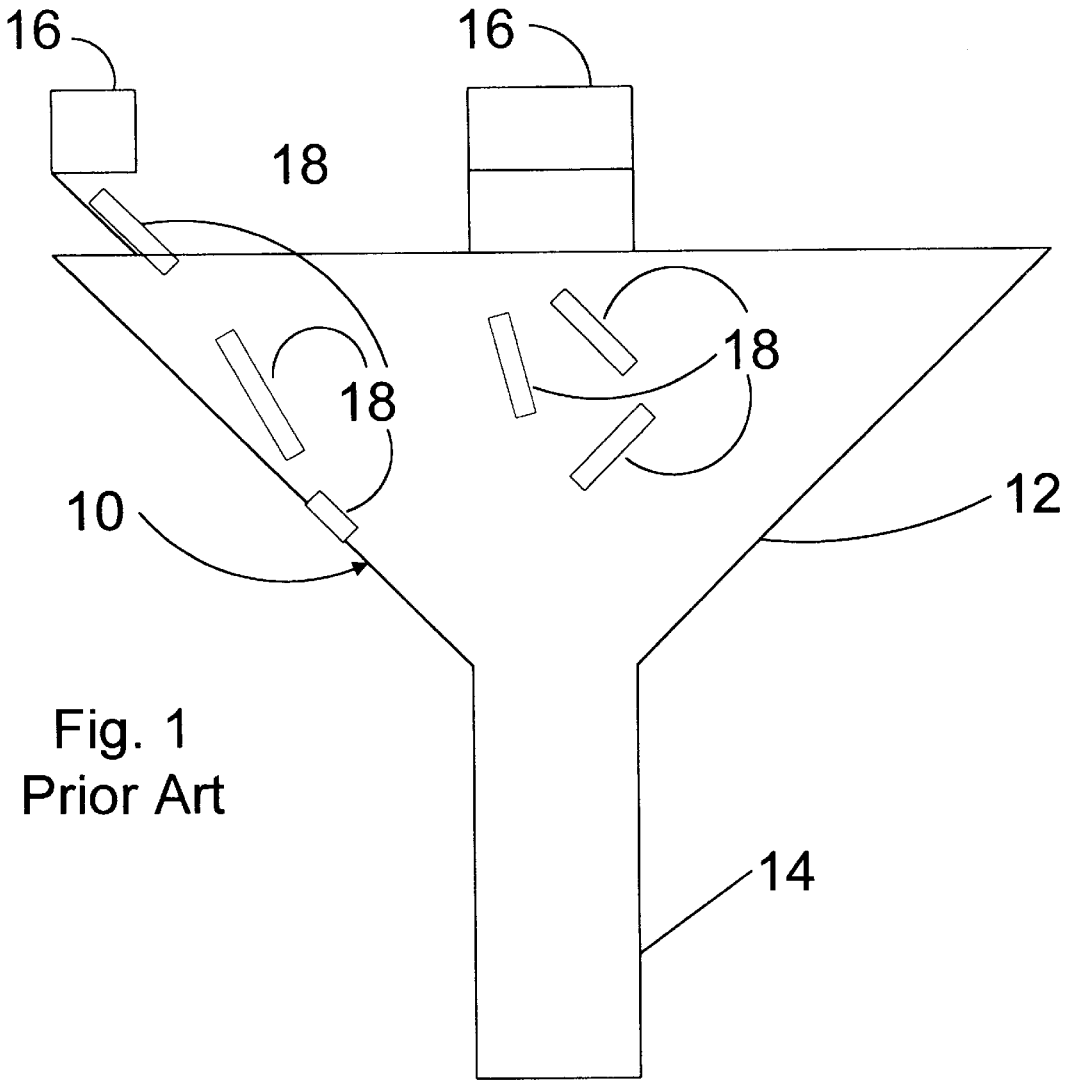
Fig. 1
Prior Art
Fig. 2a
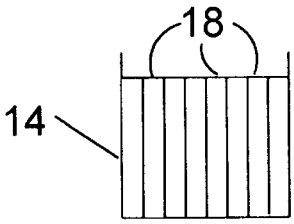
Fig. 2b
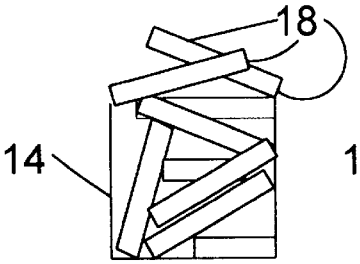
Fig. 2c
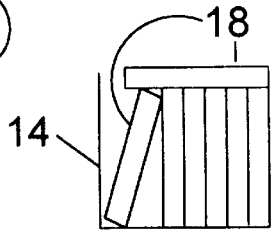

PRODUCT ORIENTATION FOR ELONGATED PRODUCTS

BACKGROUND OF THE INVENTION

This invention relates to vertical form, fill and seal machines, and in particular to an orientation device for orienting disoriented products prior to packaging.

In many packaging applications, and particularly when long products are packaged together, it is necessary to first orient the products going into the package before the group of products is actually inserted into the package. Long products, which typically have a longitudinal axis which is many times the length of any other dimension of the products, often need to be packaged in discreet groups. Products of this type have traditionally been packaged on horizontal form, fill and seal machines, where individual products are grouped and then inserted as a group onto a moving film. This insures a positive placement of the group of products with respect to end seals of the ensuing package as well as orienting the products in a horizontal format in order to avoid any bridging or gaps. At all times, the product is oriented in a known manner and is under control by the elements of the machine so that final orientation in the package can be assured.

In a vertical form, fill and seal machine, control of the products is temporarily lost as products are passed vertically from the feed system into the tube. In modem scale feed systems, a series of individual groups of products are "dumped" from a series of feeders or buckets, and are combined to produce a desired number or weight of the products. While a very accurate method of producing precise deliveries occurs at high speeds, because control of the products is temporarily lost as the products are dumped, there is no guarantee of the orientation of the products at the time of their recombination while they are being packaged. In such an apparatus, products fall down a transition chute into a discharge tube and then into a package. From the time that products are initially released until they reach the package, their fall is typically regulated by gravity. The only orientation is typically due to the tube which confines the products. In many instances, bridging occurs as the products fall, requiring the use of clearing devices such as pneumatically-operated pokers, shakers or the like.

Often, too, if individual groups of products are dumped simultaneously, products from sources oriented in opposing positions can collide at the end of the transition chute and effectively bridge or stop for a short period of time before transitioning down the tube. This results in products being delayed from extending down the product delivery tube, a condition known as "string out". The string out can cause timing problems as well as product orientation problems during the downward fall of the products.

Additional problems can exist if the size of the package is to be relatively tight in relation to the products contained therewithin. If the package is incapable of accepting products at random, unless the products are properly oriented, one or more of the products will extend into the intended sealing area, resulting in either damage to the product or having the product interfere with the quality of the seal of the package, or both.

As a result, in the past devices such as vibrators, shakers and pokers have been developed to try to properly orient products as they are being packaged. Vibrators are often employed on the product delivery tube to keep products from clinging to the inside of the tube, and have also been used to attempt to orient product in the tube. Shakers comprise various devices which clamp to the package and shake the package prior to the time that the package is sealed. Pokers consist of pneumatic operated cylinders or mechanical devices that are used to strike the bridged product in an attempt to eliminate the jam and orient the product in the package to minimize the volume and thus reduce the possibility of trapping product in the seal area as the package is sealed. Pokers rely on breaking the product into smaller pieces to clear the jam. While this is satisfactory in some applications such as the snack food industry, it is generally not acceptable to the candy, cookie or cracker industries. All of these devices, however, merely add to the cost of the apparatus and are marginally successful in attaining their desired goals.

SUMMARY OF THE INVENTION

The invention relates to an orientation device for a vertical product filling apparatus. The orientation device comprises a product receipt station for receiving a plurality of unoriented products and a product discharge station, spaced laterally from the product receipt station, for discharging oriented products. Means is provided for indexing the products in discrete groups from the product receipt station to the product discharge station, and means is provided between the product receipt station and the product discharge station for orienting the products of each group.

In accordance with the preferred form of the invention, at least one settling station is located between the product receipt station and the product discharge station. Preferably, a plurality of the settling stations is employed to assure proper orientation of the discharged products. A reject station is also employed proximate the product discharge station so that improperly oriented products can be rejected before packaging.

In accordance with the preferred form of the invention, the stations are located on a moveable bed. Each station includes a product retainer and a guide leading into the product retainer. Preferably, the guide comprises the configuration of a funnel.

Three forms of the means for product orienting are depicted in the drawing figures. First is a means for shaking the product retainer. Second is a means for expanding and contracting the volume of the product retainer. Third is a bottom ram arrangement located in the product retainer. Means is also provided for activating the ram, one such means comprising an air-activated cylinder connected to the ram. Another such means comprises a cam follower connected to the ram with the cam follower traversing an appropriately-shaped cam track.

In the preferred form of the invention, the moveable bed comprises a carrousel. A plurality of product settling stations is located between the product receipt station and the product discharge station on the carrousel. A reject station is also provided, proximate the product discharge station, for rejecting improperly oriented products.

BRIEF DESCRIPTION OF THE DRAWINGS

The invention is described in greater detail in the following description of examples embodying the best mode of the invention, taken in conjunction with the drawing figures, in which:

FIG. 1 is a schematic illustration of a series of elongated products as they are emitted from their hoppers and are sliding down a transition funnel to the product discharge tube, FIGS. 2*a* through 2*c* illustrate various orientations of products as they accumulate in the bottom of the product discharge tube.

DESCRIPTION OF EXAMPLES EMBODYING THE BEST MODE OF THE INVENTION

Figure 3:
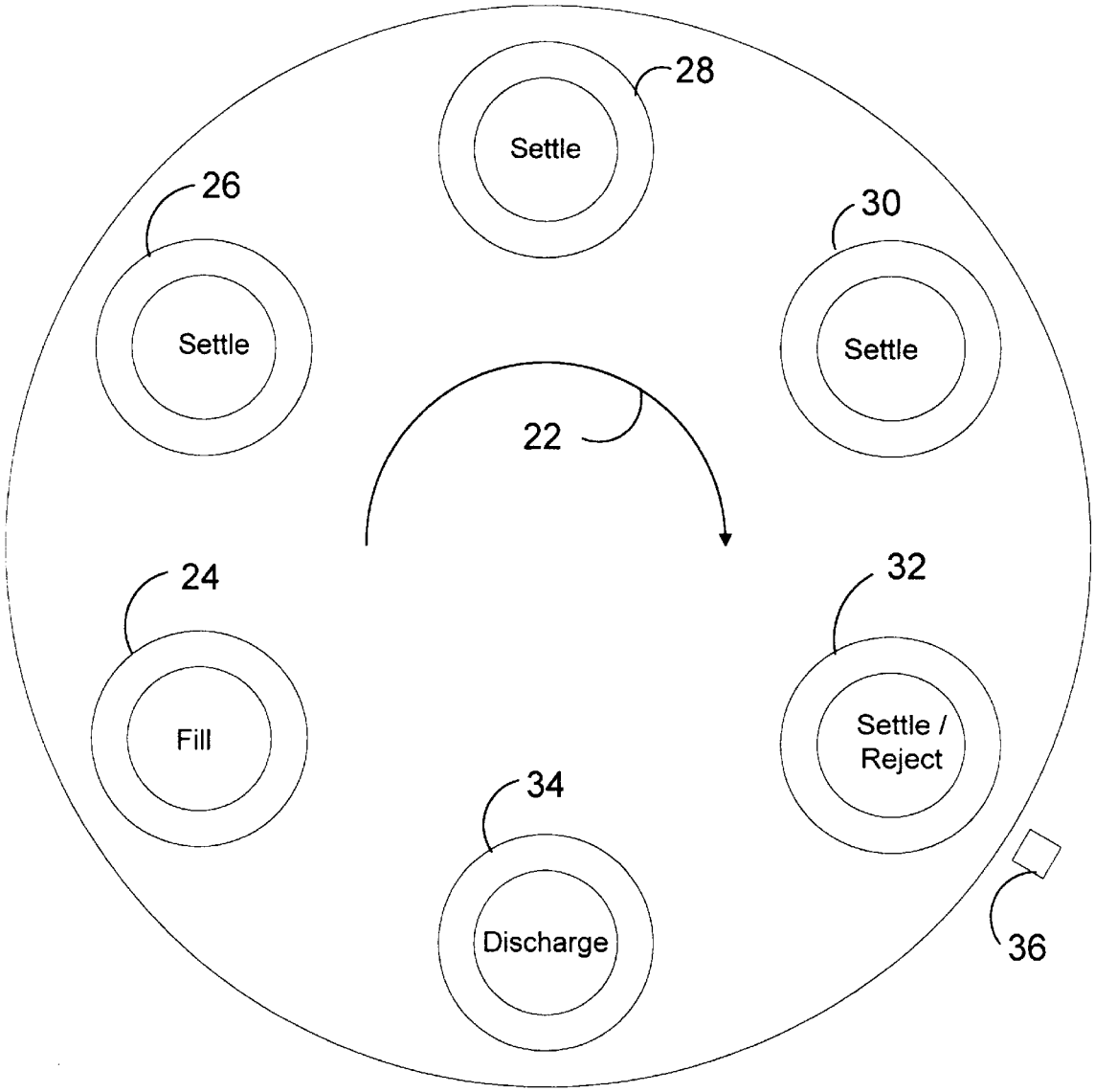
FIG. 3 is a top schematic illustration of one form of the invention, illustrating a carrousel arrangement for product accumulation, orientation and discharge.

FIG. 1 illustrates, schematically, a prior means of accumulating a series of elongated products for packaging purposes in a vertical form, fill and seal apparatus. Such an apparatus is depicted, for example, in U.S. Pat. No. 4,288,965, the disclosure of which is incorporated herein by reference, but which forms no part of the present invention. Other types of vertical form, fill and seal machines and apparatus can be employed as would be evident to one skilled in the art.

In FIG. 1, the accumulation apparatus 10 comprises an inclined transition funnel 12 leading to a discharge tube 14. Typically, products are accumulated in a series of net weight scales 16 located above the transition funnel 12. The scales 16 are connected to a central processor (not illustrated) and periodically, various combinations of the scales are activated to dump elongated products 18 to the transition funnel 12 and then into the discharge tube 14. The apparatus 10 is conventional and has been used for years.

Ideally, the products 18 enter the discharge tube 14 in a vertical orientation, and accumulate in an upright orientation without gaps as illustrated in FIG. 2*a*. However, the ideal rarely occurs, and instead, product orientations as illustrated in FIGS. 2*b* and 2*c* often occur, with a random orientation illustrated in FIG. 2*b* and an orientation with generally upright positions shown in FIG. 2*c*, but with one or more of the products 18 lying horizontally. This most difficult orientation has, in the past, vexed machine operators since no matter how much vibrating, shaking or volume changing occurs, it is difficult to reorient the products once they are located as such in the discharge tube 14.

FIG. 3 schematically illustrates one form of the invention according to the present application for properly orienting series of the elongated products 18. Depicted is a carrousel 20 which is rotated in a clockwise direction as depicted by the arrow 22 by what may be a conventional means (not illustrated) of rotational movement. The carrousel 20 carries a series of identical volumetric cups for accepting and orienting the products 18, the cups being located in a series of stations and identified by the functions of their particular positions in time, but are otherwise physically identical to one another. Thus, a fill station 24 is depicted, followed in sequence by three settling stations 26, 28 and 30. Next is a settling and rejection station 32, followed by a discharge station 34. The stations 24 through 34, for the purposes of description, will be identified by their various functions but their cups are otherwise identical and the identification of a cup as a "fill", "settle", etc. cup depends solely on its instantaneous position on the carrousel 20.

The fill station 24 is positioned to accept an incoming series of the elongated products 18, such as a discharge from the discharge tube 14 of the accumulation apparatus 10 illustrated in FIG. 1. Once a charge of the products 18 located in the fill station 24, the carrousel 20 is indexed one position, or 60°, so that the previous fill station 24 then occupies the position of the first settle station 26.

In the positions 26, 28 and 30, orientation of the randomly received products 18 occurs, with final settling and orientation occurring at the settle and reject station 32. An electric eye 36, or similar detector, is used in combination with the settle and reject station 32 so that if products are not properly oriented at the station 32 at the time the carrousel 20 is to be indexed, the entire group products 18 can be rejected before the station 32 is indexed to the position of the discharge station 34.

Therefore, the invention provides a series of "stations" for accepting, orienting and finally discharging a group of the elongated products 18. While a carrousel 20 is preferred, it will be evident that other arrangements, such as a conveyor arrangement, could be used as well, and the number of settlings stations between the fill station 24 and the discharge station 34 may be increased or decreased, depending on the nature of the apparatus developed and the products being accommodated.

Figure 4:
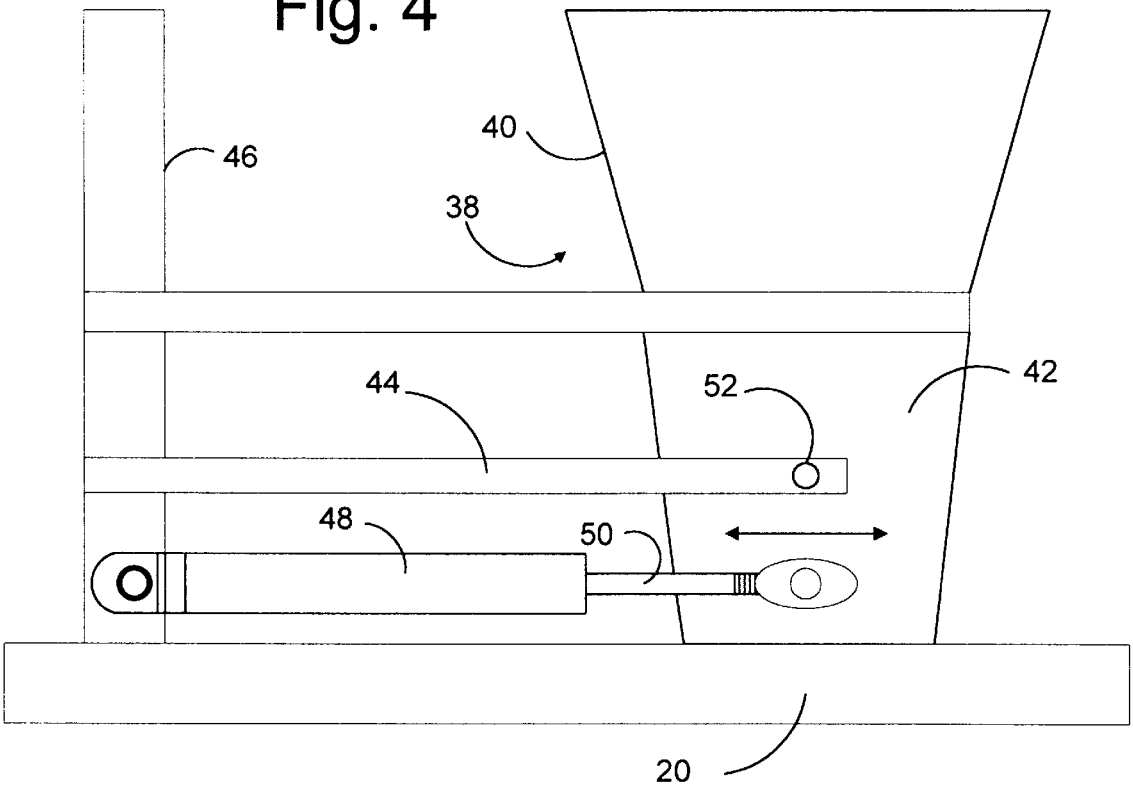
FIG. 4 is an enlarged, side elevational schematic illustration of one means of orienting elongated products by shaking.

One form of settling and product orientation is illustrated in FIG. 4. In this form, each cup 38 is composed of an upper fixed funnel 40 which comprises a guide leading to a lower product retainer 42. The product retainer 42 is pivotally mounted on an arm 44 extending from a post 46. A pneumatic cylinder 48 is secured to the bottom of the product retainer 42, and as illustrated, by extension and retraction of the ram 50 of the cylinder 48, the product retainer 42 rotates about the pivot axis 52 settling products randomly located within the product retainer 42. The cylinder 48 can be activated in at least each of the settle stations 26 through 32 providing many opportunities for the products 18 to be oriented before the decision is made at the station 32 as to whether to pass the oriented products on for discharge at the station 34, or reject an improperly oriented group of products.

Figure 5:
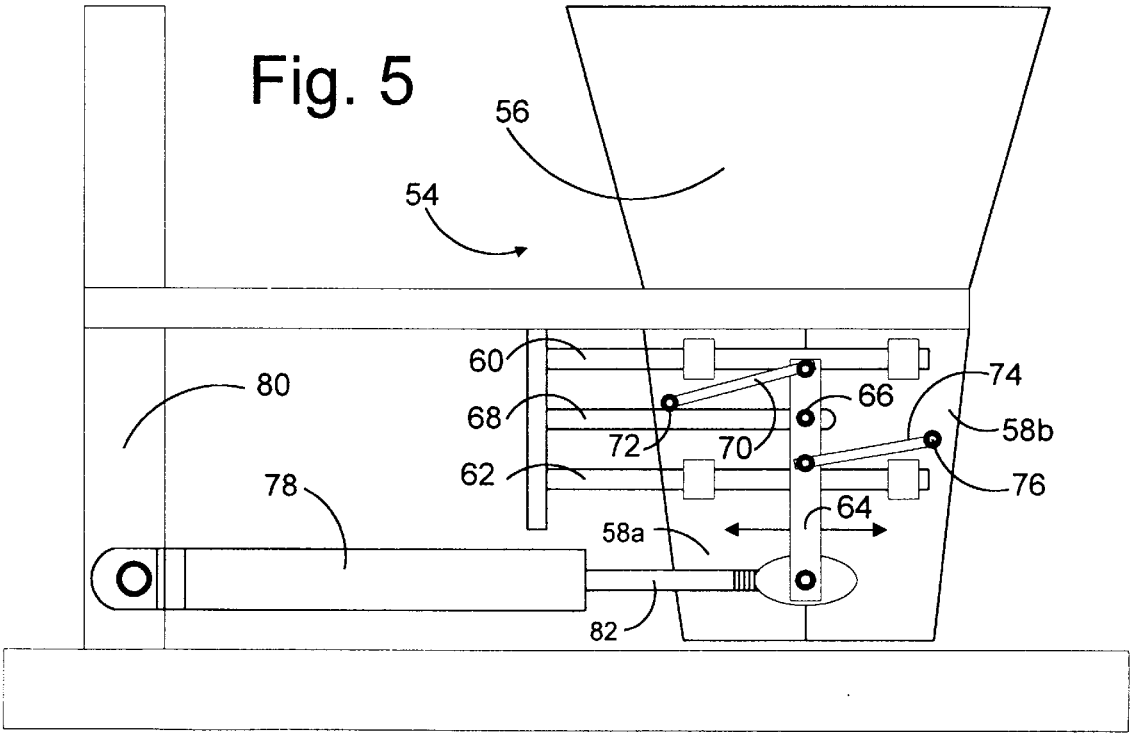
FIG. 5 is an enlarged, side-elevational schematic illustration of a second means of orienting elongated products by changing enclosure volume.

A second form of product orientation is illustrated in FIG. 5. In this form of the invention, the cup 54 is also comprised of two basic portions, a fixed funnel 56 and a product retainer 58 comprising retainer halves 58*a* and 58*b*. The retainer halves 58*a* and 58*b* are slidably mounted on fixed horizontal rods 60 and 62. An actuation rod 64 is pivotally mounted at a pivot 66 on a further fixed horizontal rod 68. One arm 70 extends from above the pivot 66 and is pivotally attached at 72 to the first retainer half 58*a* . A second arm 74 extends beneath the pivot 66 to a second pivot connection 76 on the retainer half 58*b*. A pneumatic cylinder 78 extends from a fixed post 80, having its ram 82 pivotally secured to the bottom of the actuation rod 64. Thus, extension or retraction of the ram 82 pivots the actuation rod 64 about the fixed pivot 66, causing the retainer halves 58*a* and 58*b* to open and close, orienting the products 18 therewithin, by changing the volume of the accumulator.

Figure 6:
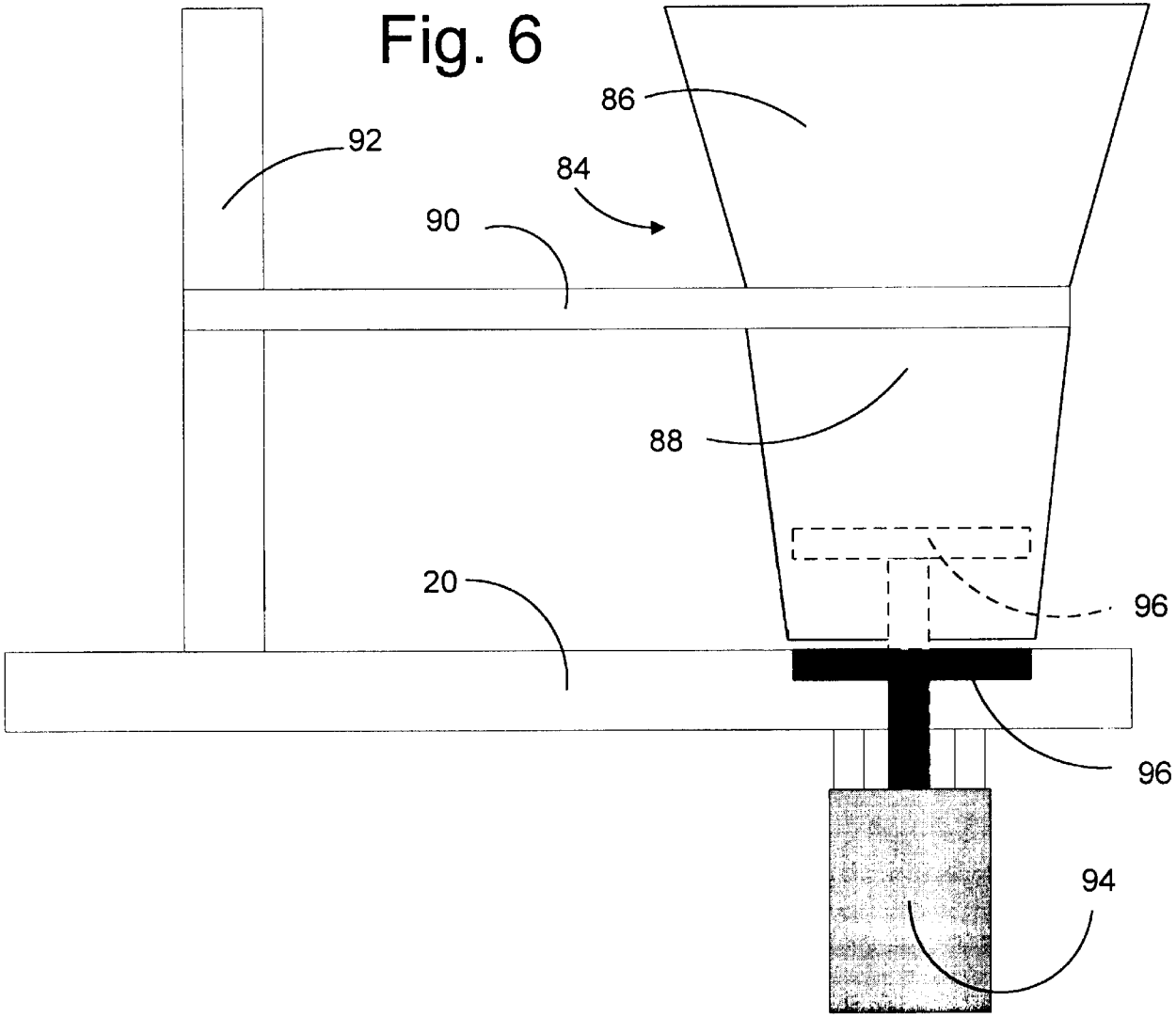
FIG. 6 is an enlarged, side-elevational illustration of a third form of orienting products by pulsing from the bottom.

A further cup 84 is illustrated in FIG. 6. In this version of the invention, a fixed funnel 86 is oriented over a product retainer 88, the funnel 86 and the product retainer 88 being mounted on an arm 90 extending from a post 92. A pneumatic cylinder 94 is mounted beneath the carrousel 20, having a ram 96 which is extensible, as illustrated in phantom in FIG. 6, for raising or lowering elongated products 18 within the retainer 88. By judicious activation of the pneumatic cylinder 94, the ram 96 can be raised and lowered within the product retainer 88, orienting the products 18 contained therewithin.

Figure 7:
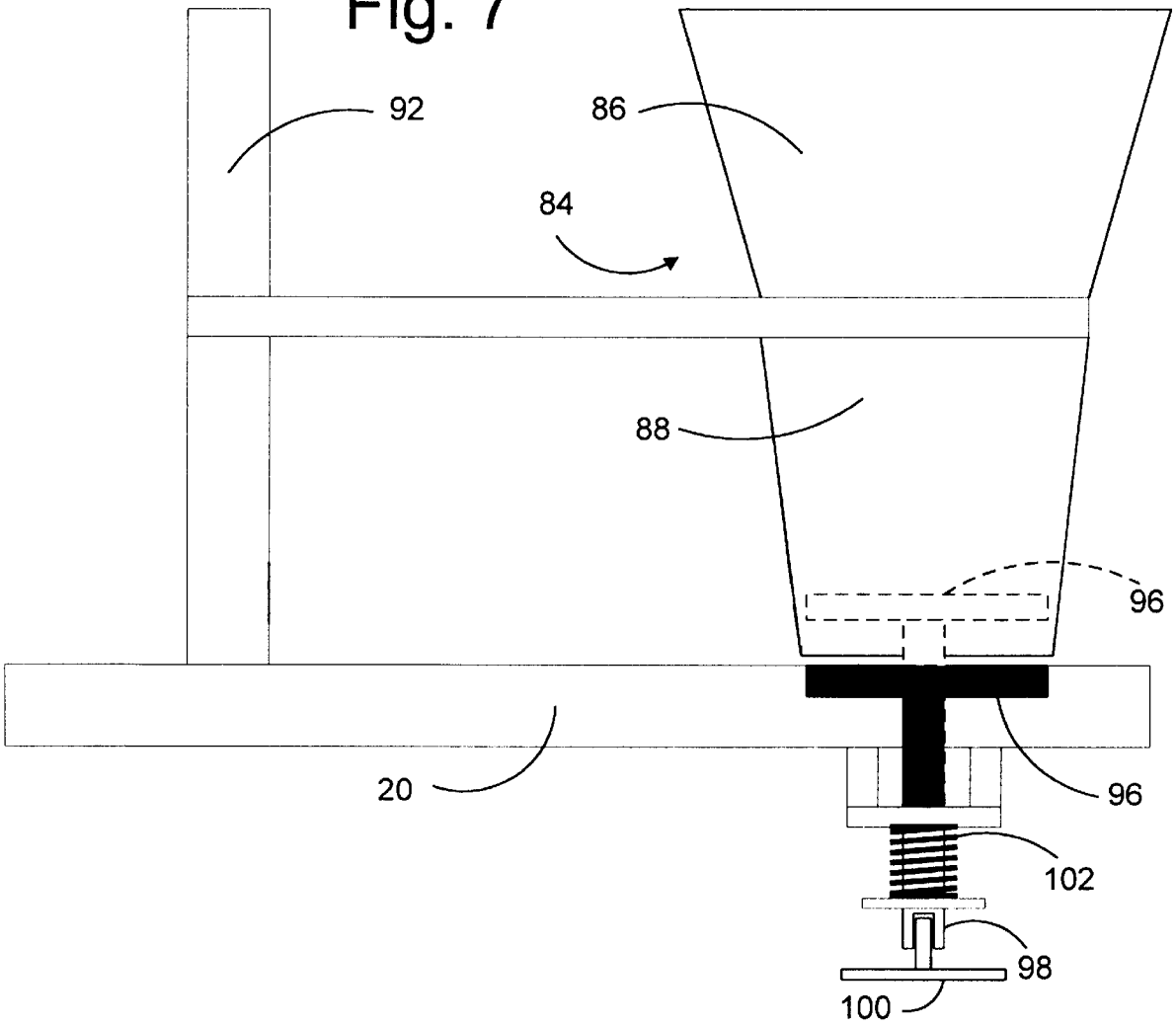
FIG. 7 is a view similar to FIG. 6, but with a different means of actuating of the product settling ram.

FIG. 7 illustrates a modified version of the form illustrated in FIG. 6, where the pneumatic cylinder 94 has been eliminated and replaced by a cam follower 98 which traverses a cam 100. A spring 102 is used to downwardly bias the cam follower 98 on the cam track 100. The stroke of the ram 96 and the frequency of its oscillations will depend on the velocity of rotation of the carrousel 20 and the configuration of the cam 100. Obviously, for orientation to occur in the version illustrated in FIG. 7, the carrousel 20 must be rotating, while in the version illustrated in FIG. 6, the ram 96 can be actuated by the pneumatic cylinder 94 whether or not the carrousel 20 is rotating.

In the versions illustrated in FIGS. 4 and 5, at the discharge station 34, discharge can be vertically downwardly from the bottoms of the product retainers 42 and 58 (means not illustrated). In the version illustrated in FIG. 6, the rams 96 retract into the carousel plate 20, which is stationary, during movement of the product retainers 88. Discharge is accomplished through a discharge hole in the carousel plate 20 as the product retainers 88 move over the hole. In the version illustrated in FIG. 7, the carousel plate 20 rotates and the ram 96 travels with the product retainer 88, and must be mounted to swing away from beneath the product retainer 88 in order to discharge the contents of the retainers 88.

Figure 8A:
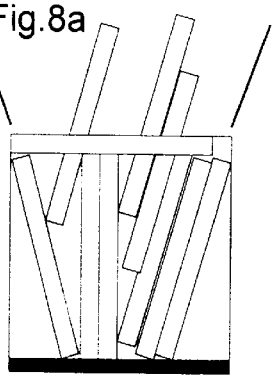
FIGS. 8*a* through 8*c* depict a first step in product orientation utilizing the rams of FIGS. 6 and 7, FIGS. 9*a* through 9*c* illustrate a second step of product orientation.
Figure 8B:
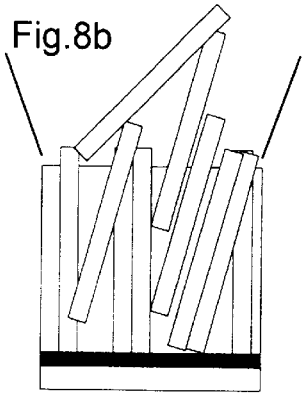
Figure 8C:
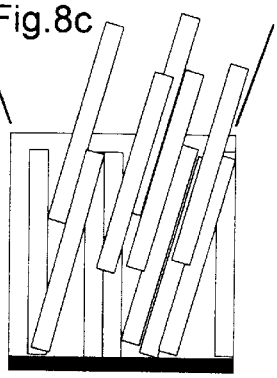

FIGS. 8 through 11 illustrate a series of four stations in the settling sequence of the ram-activated version illustrated in FIGS. 6 and 7. Turning first to FIG. 8, in FIG. 8*a*, elongated products 18 have randomly entered the product retainer 88 and rest on the ram 96. In FIG. 8*b*, the ram 96 has been activated upwardly to begin the settling process, and in FIG. 8*c*, the ram 96 has settled to its rest position, with the first step of product orientation having taken place. It is to be particularly noted that the product which was originally laying horizontally when dispensed has been upended into a vertical orientation.

Figure 9A:
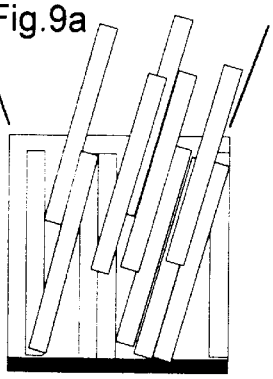
Figure 9B:
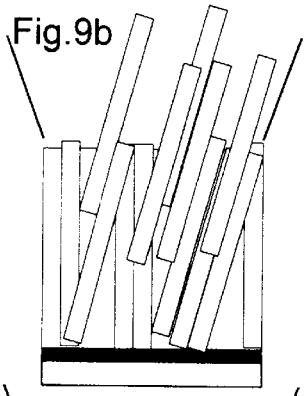
Figure 9C:
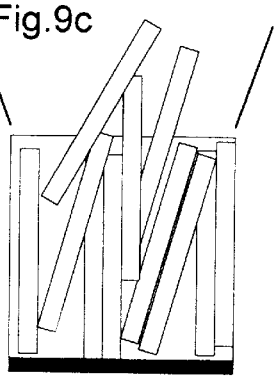

In FIG. 9, the next step takes place, and as illustrated, the position in FIG. 9*a* corresponds exactly to that in FIG. 8*c*. In FIG. 9*b*, the ram 96 is activated upwardly commencing the second orientation cycle, and when the ram 96 returns to its rest position, the products 18 are reoriented as shown in FIG. 9*c*.

Figure 10A:
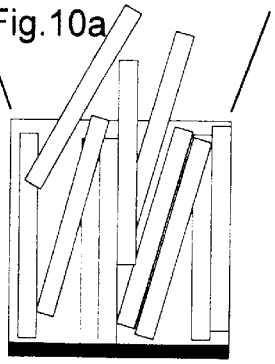
FIGS. 10*a* through 10*c* illustrate a third step of product orientation.
Figure 10B:
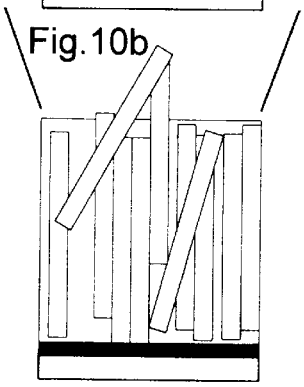

The third sequence of settling is illustrated in FIG. 10, again with FIG. 10*a* corresponding exactly to the orientation shown in FIG. 9*c*. In FIG. 10*b*, the ram 96 is activated, commencing the reorientation and when the ram 96 returns to its rest position as shown in FIG. 10*c*, the products 18 are further reoriented as illustrated.

Figure 10C:
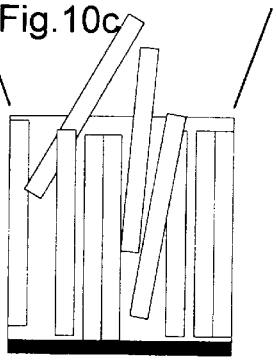
Figure 11A:
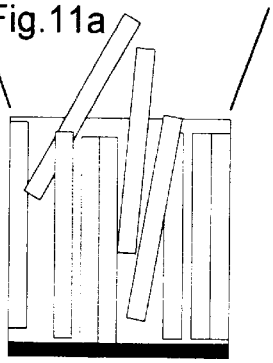
FIGS. 11*a* through 11*c* illustrate a fourth and final step of product orientation.
Figure 11B:
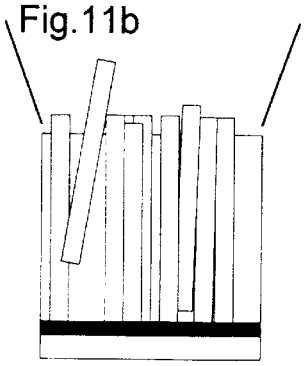
Figure 11C:
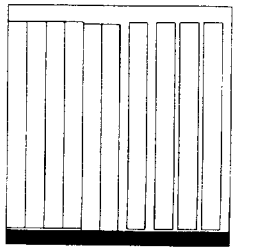

Finally, FIG. 11 illustrates a fourth and final orientation step, again with FIG. 11*a* depicting the products 18 exactly as they appear in FIG. 10*c*. In FIG. 11*b*, the ram 96 is activated upwardly, and is then returned in FIG. 11*c*. By this final step, all of the products 18*a* have been oriented vertically with their longitudinal axes essentially parallel to one another, as illustrated. Proper orientation has thus occurred, and if the carrousel 20 is employed, the electric eye 36 would sense that proper orientation has occurred, permitting the oriented products 18 to advance to the discharge station 34, for subsequent packaging in the vertical form, fill and seal apparatus.

The invention provides a simple, yet effective means of properly orienting long products 18 so that their longitudinal axes are essentially parallel to one another and oriented vertically. Various changes can be made to the invention without departing from the spirit thereof or scope of the following claims.

What is claimed is:

1. An orientation device for a vertical product filling apparatus, comprising a. a product receipt station for receiving a plurality of unoriented products, b. a product discharge station spaced laterally from said product receipt station for discharging oriented products, c. means for indexing said products in discrete groups from said product receipt station to said product discharge station, d. means between said product receipt station and said product discharge station for orienting said products of each group, and e. means between said product receipt station and said product discharge station for rejecting an unoriented group of said products.

2. An orientation device according to claim 1 including at least one settling station located between said product receipt station and said product discharge station.

3. An orientation device according to claim 2 including a plurality of said settling stations.

4. An orientation device according to claim 1 in which said means for rejecting comprises a reject station proximate said product discharge station.

5. An orientation device according to claim 1 in which said stations are located on a moveable bed.

6. An orientation device according to claim 5 in which each station includes a product retainer and a guide into said product retainer.

7. An orientation device according to claim 6 in which said guide comprises a funnel.

8. An orientation device according to claim 6 in which said means for orienting comprises means for shaking said product retainer.

9. An orientation device according to claim 6 in which said means for orienting comprises means for expanding and contracting said product retainer.

10. An orientation device according to claim 6 in which said means for orientating comprises a bottom ram in said product retainer.

11. An orientation device according to claim 10 including means for activating said ram.

12. An orientation device according to claim 11 in which said means for activating comprises a cylinder connected to said ram.

13. An orientation device according to claim 11 in which said means for activating comprises a cam follower connected to said ram, said cam follower traversing a cam.

14. An orientation device according to claim 5 in which said movable bed comprises a carrousel.

15. An orientation device according to claim 14 including a plurality of product settling stations located between said product receipt station and said product discharge station.

16. An orientation device according to claim 15 including a reject station proximate said product discharge station.

17. An orientation device for orienting longitudinal axes of products being packaged in a vertical product filling apparatus, comprising a. a movable bed, b. a product receipt station on said movable bed for receiving a plurality of unoriented products, c. a product discharge station on said movable bed and spaced from said product receipt station for discharging oriented products, d. at least one settling station located on said movable bed between said product receipt station and said product discharge station, e. a product retainer at each station and a guide leading into said product retainer, f. means for indexing said products in said product retainers in discrete groups from said product receipt station to said product discharge station, g. means at at least each settling station for orienting said products of each group with the longitudinal axes of said products being oriented essentially vertically at said discharge station, and h. means between said product receipt station and said product discharge station for rejecting an unoriented group of said products.

18. An orientation device according to claim 17 in which said means for orientating comprises a bottom ram in said product retainer.

19. An orientation device according to claim 18 including means for activating said ram.

20. An orientation device according to claim 17 in which said movable bed comprises a carrousel.

* * * * *